US010426022B2

(12) United States Patent
Kazakevich

(10) Patent No.: US 10,426,022 B2
(45) Date of Patent: Sep. 24, 2019

(54) PULSED POWER GENERATION USING MAGNETRON RF SOURCE WITH INTERNAL MODULATION

(71) Applicant: Muons, Inc., Batavia, IL (US)

(72) Inventor: Grigory M. Kazakevich, North Aurora, IL (US)

(73) Assignee: Muons, Inc., Batavia, IL (US)

( * ) Notice: Subject to any disclaimer, the term of this patent is extended or adjusted under 35 U.S.C. 154(b) by 0 days.

(21) Appl. No.: 16/115,293

(22) Filed: Aug. 28, 2018

(65) Prior Publication Data

US 2019/0069387 A1 Feb. 28, 2019

Related U.S. Application Data

(60) Provisional application No. 62/551,066, filed on Aug. 28, 2017.

(51) Int. Cl.
*H05H 7/02* (2006.01)
*H01J 25/50* (2006.01)

(52) U.S. Cl.
CPC ..... *H05H 7/02* (2013.01); *H01J 25/50* (2013.01); *H05H 2007/025* (2013.01); *H05H 2007/027* (2013.01)

(58) Field of Classification Search
USPC ..... 315/39.51
See application file for complete search history.

(56) References Cited

U.S. PATENT DOCUMENTS

| | | | | |
|---|---|---|---|---|
| 7,863,988 | B2 | 1/2011 | Baek et al. | |
| 10,028,369 | B2 * | 7/2018 | Radovinsky | H05H 13/02 |
| 2004/0026235 | A1 | 2/2004 | Stowell, Jr. | |
| 2012/0326636 | A1 | 12/2012 | Eaton et al. | |
| 2017/0071054 | A1 * | 3/2017 | Benson | H05H 9/044 |
| 2017/0237225 | A1 * | 8/2017 | Nikipelov | H01S 3/0903 372/2 |
| 2017/0250651 | A1 * | 8/2017 | Kazakevich | H03B 9/10 |
| 2017/0280549 | A1 * | 9/2017 | Chase | G01P 15/00 |

(Continued)

FOREIGN PATENT DOCUMENTS

| | | | |
|---|---|---|---|
| KR | 10-2009-0030065 | A | 3/2009 |
| WO | WO-2016/043783 | A1 | 3/2016 |
| WO | WO-2016/091915 | A1 | 6/2016 |

OTHER PUBLICATIONS

Chase, B., et al., "Precision vector control of a superconducting RF cavity driven by an injection locked magnetron", 2015 Journal of Instrumentation 10 P03007, (2015), 14 pgs.

(Continued)

*Primary Examiner* — Dion Ferguson
*Assistant Examiner* — Srinivas Sathiraju
(74) *Attorney, Agent, or Firm* — Schwegman Lundberg & Woessner, P.A.

(57) ABSTRACT

A system uses one or more magnetrons to generate pulsed radio-frequency (RF) power, such as for powering an accelerating cavity. The one or more magnetrons each having a self-excitation threshold voltage and configured to operate with internal modulation using a pulsed RF input signal to produce the pulsed RF power when being powered by a direct-current power supply at a voltage level below the self-excitation threshold voltage.

20 Claims, 8 Drawing Sheets

(56) References Cited

U.S. PATENT DOCUMENTS

2019/0069387 A1* 2/2019 Kazakevich ..... H01J 25/50

OTHER PUBLICATIONS

Kapitza, P. L., "High Power Electronics", Soviet Physics Uspekhi, V 5, No. 5, (1963), 777-826.
Kazakevich, G., et al., "High-Power Magnetron RF Source for Intensity-Frontier Superconducting Linacs", EIC 2014, TUDF1132_TALK [online]. Retrieved from the Internet: <URL:// http://appora.fnal.gov/pls/eic14/agenda.full>, (2014), 24 pgs.
Kazakevich, G., et al., "Resonant interaction of the electron beam with a synchronous wave in controlled magnetrons for high-current superconducting accelerators", Physical Review Accelerators and Beams 21, 062001 (2018), Published by the American Physical Society, (2018), 12.
Kazakevich, Gregory, et al., "An efficient magnetron transmitter for superconducting accelerators", Nuclear Instruments and Methods in Physics Research Section A, vol. 839, (2016), 43-51.
Kazakevich, Grigory, et al., "Nuclear Instruments and Methods in Physics Research A", Nuclear Instruments and Methods in Physics Research A 760 (2014), (2014), 19-27.
"International Application Serial No. PCT/US2018/048384, International Search Report dated Dec. 20, 2018", 3 pgs.
"International Application Serial No. PCT/US2018/048384, Written Opinion dated Dec. 20, 2018", 6 pgs.
Kazakevich, G., et al., "Regime of wideband phase-amplitude modulation in a CW magnetron transmitter with a phase control", [online]. Retrieved from the Internet: <URL: https://arxiv.org/ftp/arxiv/papers/1407/1407.0304.pdf>, (Jul. 2014), 6 pgs.

* cited by examiner

PULSED POWER GENERATION USING MAGNETRON RF SOURCE WITH INTERNAL MODULATION

CLAIM OF PRIORITY

This application claims the benefit of priority under 35 U.S.C. § 119(e) of U.S. Provisional Patent Application Ser. No. 62/551,066, entitled "HIGH-POWER PULSED MAGNETRON TRANSMITTER WITH INTERNAL HIGH VOLTAGE MODULATION", filed on Aug. 28, 2017, which is herein incorporated by reference in its entirety.

TECHNICAL FIELD

This document relates generally to Radio Frequency (RF) power generation and more particularly to a magnetron transmitter with internal pulse modulation of output power. Applications can include, for example, powering of Superconducting RF (SRF) cavities of intensity-frontier pulsed accelerators.

BACKGROUND

Modern intensity-frontier superconducting pulsed accelerators need Radio Frequency (RF) sources with pulsed power up to hundreds of kilowatts at an average power of tens of kilowatts to support the phase and amplitude instability of SRF cavity accelerating fields to much less than 1 degree and 1%, respectively. Compensations for harmful effects of microphonics, Lorentz Force Detuning (LFD), and beam loading are provided by dynamic phase and power control to support accelerating field stability at the required level. Successful implementation of such control requires sufficiently wide bandwidth of the RF transmitter.

The traditional RF sources such as klystrons, Inductive Output Tubes (IOTs), and solid-state amplifiers are expensive, and their cost represents a significant fraction of the accelerator project cost. Usage of megawatt (MW)-scale klystrons feeding groups of cavities allows some cost reduction, but modulators for MW-scale klystrons are quite expensive. Moreover, this choice only provides control of the vector sum of the accelerating voltage for a group of cavities, which may be insufficient to minimize longitudinal beam emittance. Therefore, RF sources that are dynamically controlled in phase and power around the carrier frequency, feeding each SRF cavity individually, and operating without high-voltage modulators are preferable for high intensity pulsed accelerators in large-scale projects.

Magnetrons are more efficient and less expensive than the above-mentioned traditional RF sources [1]. The low capital cost of magnetron power (e.g., up to 1 US Dollar per Watt) allows powering each cavity individually, which greatly improves stability of the voltage and phase in each cavity. Thus, utilization of magnetron RF sources in large-scale accelerator projects can significantly reduce the cost of an RF power generation system.

SUMMARY

A system uses one or more magnetrons to generate pulsed radio-frequency (RF) power, such as for powering an accelerating cavity. The one or more magnetrons each having a self-excitation threshold voltage and configured to operate with internal modulation using a pulsed RF input signal to produce the pulsed RF power when being powered by a direct-current (DC) power supply at a voltage level below the self-excitation threshold voltage.

In one embodiment, a system for RF power generation may include an RF pulsed transmitter configured to produce a pulsed RF output signal using a pulsed magnetron output signal. The pulsed RF transmitter can include an input, an output, a magnetron, and a DC power supply. The input receives a pulsed RF input signal. The output transmits the pulsed RF output signal. The magnetron has a self-excitation threshold voltage and may be configured to operate with internal modulation using the pulsed RF input signal to produce the pulsed magnetron output signal when being powered at a voltage level below the self-excitation threshold voltage. The DC power supply may be configured to power the magnetron.

In one embodiment, a method for RF power generation is provided. The method may include receiving a pulsed RF input signal, operating a magnetron having a self-excitation threshold voltage, and producing a pulsed RF output signal using a pulsed magnetron output signal. Operating the magnetron may include powering the magnetron at a voltage level below the self-excitation threshold voltage using a DC power supply and producing a pulsed magnetron output signal by internal modulation using the pulsed RF input signal.

In one embodiment, a system for powering an accelerating cavity may include a magnetron and a cathode voltage supply system. The magnetron may be configured to receive an input injection-locking signal, to produce an injection-locked output signal using the input injection-locking signal when the input injection-locking signal allows the magnetron to operate at a subcritical cathode voltage that is below a critical voltage needed for self-excitation of the magnetron, and to interrupt the injection-locked output signal when the input injection-locking signal is not sufficiently strong to allow the magnetron to operate at the subcritical cathode voltage. The cathode voltage supply system may be coupled to the magnetron and may be configured to supply the subcritical cathode voltage and to control a power of the injection-locked output signal by controlling the cathode voltage.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
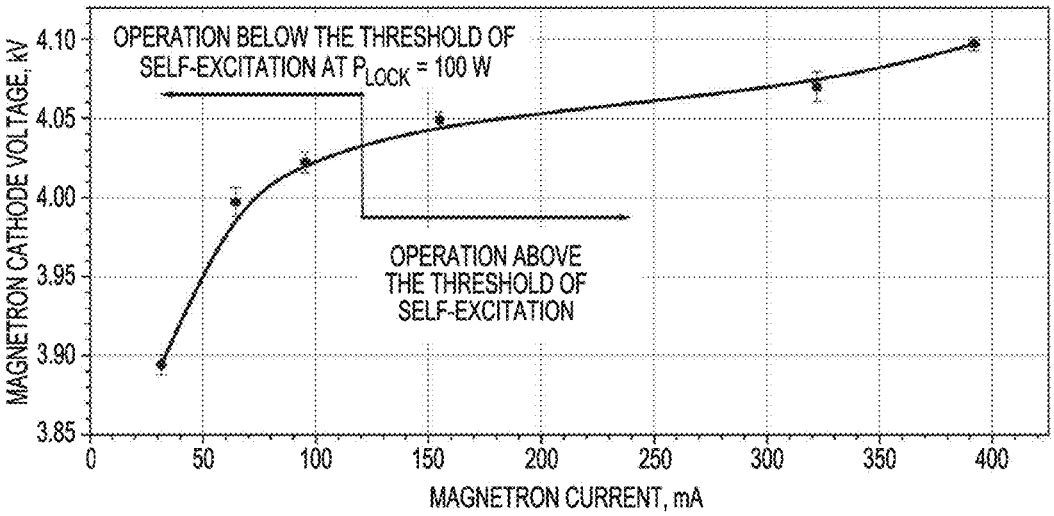
FIG. 1 is a graph showing an example of magnetron voltage-current (V-I) characteristic measured at a sufficient resonant injected (injection-locking) signal.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter was developed based on an unusual phenomenon predicted using a model of resonant interaction of electrons with synchronous wave in the magnetron space of interactions [2]. This unusual phenomenon, which is referred to as "internal modulation" in a magnetron by the inventor, includes pulsed injection-locked generation of the magnetron powered by a Direct Current (DC) power supply somewhat below its self-excitation threshold and driven by a pulsed resonant injected signal with a sufficient power (about of 10% of the magnetron nominal power). Following the prediction, the discovery of this unusual phenomenon was proven by demonstrating switching on-off a magnetron with high efficiency by the pulsed resonant injected signal when the magnetron was powered by a DC power supply and operated somewhat below the self-excitation threshold without a pulsed modulator.

This document discusses, among other things, systems of highly efficient high-power transmitters each including one or more magnetrons with internal modulation, without requiring a pulsed modulator, for powering, for example, a cavity of an intensity-frontier pulsed accelerator. Proof of concept of the principle of operation of the magnetron transmitter with internal pulsed modulation controlled by an injected resonant signal was demonstrated in experiments. The transmitter allows phase and power control with respective rates at the frequency of the injection-locking signal using phase and amplitude controlling feedback loops to suppress microphonics, Lorentz force detuning, and beam loading in the Superconducting Radio Frequency (SRF) cavities. The concept utilizes excitation of the magnetron by the resonant injected (injection-locking) signal with appropriate power. The transmitter output magnetron is powered by a High-Voltage (HV) DC power supply at a voltage less than threshold of its self-excitation. This realizes pulsed operation of the high-power injection-locked magnetron switched on-off by the resonant exciting Radio Frequency (RF) signal without a pulsed modulator. Initial experimental studies of the concept were carried out with 2.45 GHz, 1 kW, Continuous Wave (CW) microwave oven magnetrons operating in pulsed and CW regimes. Results of the substantiation the proposed concept are presented and discussed in this document.

Magnetron is a well-known inexpensive self-exciting oscillator generating coherently when its cathode feeding voltage exceeds the threshold of self-excitation. The threshold of self-excitation of a magnetron is a threshold voltage also referred to as critical cathode voltage of the magnetron. A voltage less than the threshold of self-excitation can be referred to as a subcritical cathode voltage. If the feeding voltage is less than the threshold of its self-excitation, the synchronous wave in the magnetron interaction space does not exist or has insufficient amplitude. It does not allow the required phase grouping of the charge drifting towards the magnetron anode and the moving charges cannot increment to the energy of the synchronous wave rotating in the magnetron space of interaction. This causes damping of the synchronous wave and does not allow for coherent generation of the magnetron [2]. The appearance of the synchronous wave with a sufficient amplitude (e.g., by a sufficient resonant injected signal) is a sufficient condition for appropriate shaping of the charge in "spokes" to start the coherent stable oscillation when the magnetron voltage is somewhat less than the self-excitation threshold. Existence of the synchronous wave with sufficient amplitude is a necessary condition for stable coherent generation of the magnetron.

For pulsed operation of magnetrons presently, HV pulsed modulators can be used for turning powering of the magnetron on and off. However, these modulators for superconducting accelerators deal with long-pulse, high-voltage pulsed transformers that make them large, heavy, and expensive. The present subject matter provides a pulsed magnetron RF generation using recently developed technique starting-up the magnetron below the self-excitation threshold [3]. Modeling of the resonant interaction of the electron flow with a synchronous wave in the magnetron driven by the resonant injected signal [2] indicates that the pulsed operation of the magnetron powered by a DC power supply is realized by pulsed RF resonant injected signal switching the magnetron on and off.

In various embodiments, the pulsed RF power of the magnetron can be somewhat less than the nominal magnetron power. However, in accordance with the resonant interaction model [2], the magnetron RF source efficiency and the time of life can be increased.

It was demonstrated (e.g., references [2, 3]) that the presence of a driving resonant signal with appropriate amplitude excites the resonant rotating (synchronous) wave in the magnetron space of interaction, thereby, at the sufficient wave amplitude, allowing for starting up the magnetron. This results in coherent oscillation at the frequency of the resonant signal even if the magnetron feeding voltage is somewhat less than the threshold of self-excitation. The coherent oscillation in this case is precisely-stable in frequency and can be controlled in wide band in phase and in power. A notable decrease of the synchronous wave, such as by switching off the injected resonant signal causes its fast damping and stop of the magnetron generation [2]. Thus, the presence or absence of the resonant driving wave when the magnetron voltage is by a few percent less than the self-excitation threshold can turn on-off the coherent oscillation at the frequency of the driving signal in the magnetron, i.e., the magnetron will operate in pulsed regime being powered from an inexpensive DC power supply and driven by an appropriate pulsed RF source. This is a conceptual basis of the present subject matter. The experimental tests substantiating this concept were carried out with 2.45 GHz, 1 kW magnetrons fed by pulsed and CW HV power supplies. The results are presented and discussed below.

Theoretical Substantiation of the Concept

The theoretical substantiation of the present magnetron transmitter concept is based on theory of charge drift approximation [4], theory of perturbation applied to magnetrons, [3], and developed basing on a kinetic model the resonant interaction theory for the magnetrons. [2].

A simple explanation of the present magnetron transmitter concept is based on the fundamental law of energy conservation. A resonant driving signal injected into the magnetron in accordance with the energy conservation law increases the RF energy stored in the magnetron cavities and in the interaction space. Since the RF energy in the magnetron is determined by the static electric field, the injected resonant signal is equivalent to an increase of the magnetron feeding voltage. Thus, a sufficient power of the injected resonant signal allows the magnetron to start-up even if the magnetron feeding voltage is by a few percent less than the threshold of self-excitation. This allows stable operation of the magnetron with a lower current than is available in free run. The lack of RF voltage in the synchronous wave induced by the lower magnetron current is compensated by the injection-locking signal providing stable operation of the magnetron when it is driven by the sufficient resonant injected signal. Switching the resonant injected signal off will cause damping of the synchronous wave [2], rapidly stopping power generation of the magnetron.

FIG. 1 is a graph showing an example of magnetron voltage-current (V-I) characteristic measured at the sufficient resonant injected (injection-locking) signal (about 10% of the nominal magnetron power). The V-I characteristic of a 1.2 kW, type 2M137-IL magnetron (by Richardson Electronics. LaFox, Ill., USA) was measured in CW regime at a locking power $P_{Lock}$=100 W [3]. The solid curve (B-spline fit) shows the available range of current with stable operation of the magnetron at the given locking power, $P_{Lock}$=100 W. The V-I characteristic demonstrates stable operation of the magnetron below the self-excitation threshold.

From a rough estimate of the minimum power in the synchronous wave sufficient for self-excitation of the typical magnetron, about 1/10 of the magnetron nominal power is obtained [3]. As it was demonstrated in experiments (e.g., reference [3]), this value of power of the resonant driving signal starts up the stimulated coherent oscillation in the magnetron even if the magnetron voltage is by a few percent less than the threshold voltage for self-excited oscillations.

The experiments demonstrated that a typical magnetron driven by a resonant (injection-locking) wave with power about of −10 dB of the nominal power at the feeding voltage less than the voltage of self-excitation provides stable operation of the magnetron over a wide range (10 dB) of output power. The RF power of the magnetron fed by voltage less than the self-excitation threshold can be controlled in the range up to 5 dB varying its current at the sufficient resonant pre-exciting (injection-locking) signal. Thus, the pre-excited magnetron fed by voltage less than the threshold of self-excitation may operate as an RF injection-locked coherent oscillator switched on-off by the driving injection-locking RF signal, since the presence and absence of the RF signal starts and stops operation of the magnetron, respectively. The time of switching on-off of the RF oscillation in such regime of the magnetron will be determined by the time of the transient process with establishment and damping of the synchronous wave of the order of magnitude $(10\ Q_L)/\pi f$, where $Q_L$ is the magnetron cavity loaded Q-factor ($Q_L \approx 100$), and f is the magnetron frequency. For 2.45 GHz magnetrons the switching time will not exceed 200 ns. When the driving RF signal is off, practically there is no consumption of energy of the HV power supply by a typical magnetron. Thus, the stimulated generation of the "self-modulating" injection-locked magnetron. i.e., operation with the internal pulsed modulation, is highly efficient.

Experimental Substantiation of the Concept

Experimental verification of proposed concept was carried out with 2.45 GHz, 1 kW magnetrons operating in pulsed and CW regimes, fed by a voltage less than the threshold of self-excitation. Stable operation of magnetrons with low noise at the cathode voltage less than the self-excitation threshold, when the magnetron was driven by a sufficient injected resonant signal, was demonstrated [2, 3]. More detailed measurements were performed in the CW regime with 2.5 GHz 1.2 kW magnetron type 2M137-IL.

Figure 2:
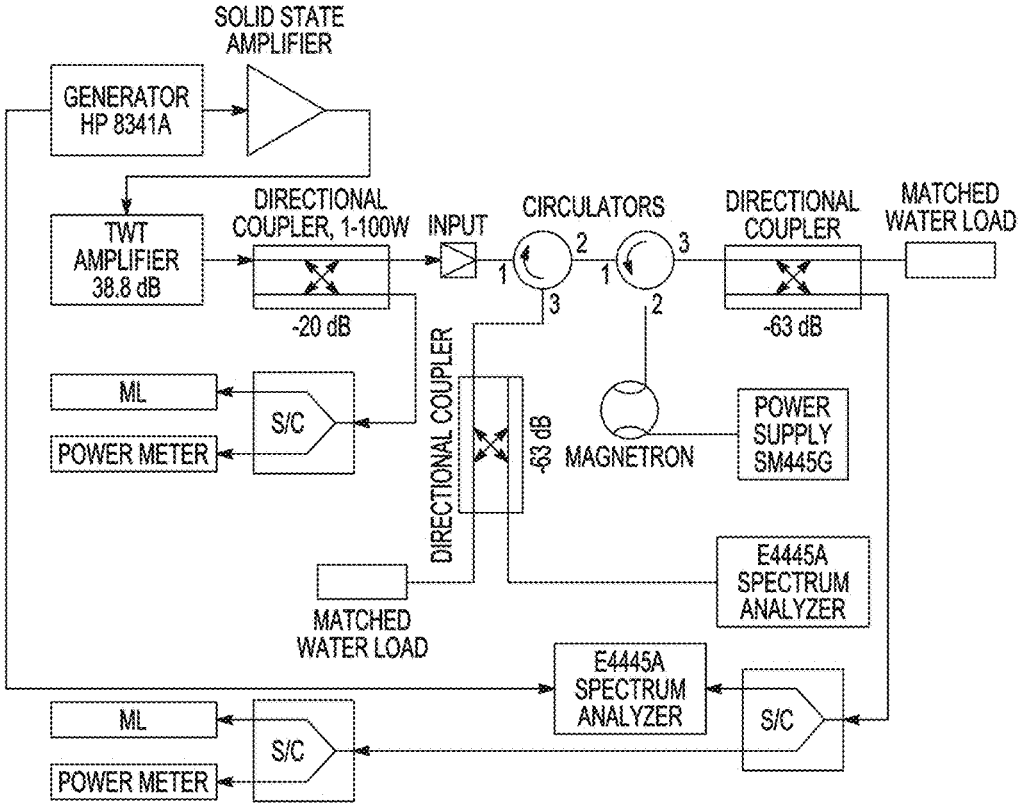
FIG. 2 is a block diagram illustrating an embodiment of an experimental setup for testing a magnetron operating in Continuous Wave (CW) regime below and above a threshold of self-excitation.

FIG. 2 is a block diagram illustrating an embodiment of an experimental setup for testing a magnetron operating in CW regime below and above the threshold of self-excitation. The magnetron was fed by an Alter switching HV power supply type SM445G (by MKS Instruments, Andover, Mass. USA), operating as a current source and allowing for current control. The magnetron was driven by a resonant (frequency-locking) signal by an HP 8341A generator via a solid-state amplifier and a 36.6 dB Traveling Wave Tube (TWT) amplifier providing CW locking power up to 100 W.

Experimental study included measurements of the power consumption of the magnetron from the HV power supply, the RF spectra of the injection-locking signal and the magnetron output signal, the RF power generated by the magnetron and the power of the injection-locking signal. The wide range (10 dB) of power control in the magnetron was realized by operation below and above the self-excitation threshold, varying the magnetron current.

Figure 3:
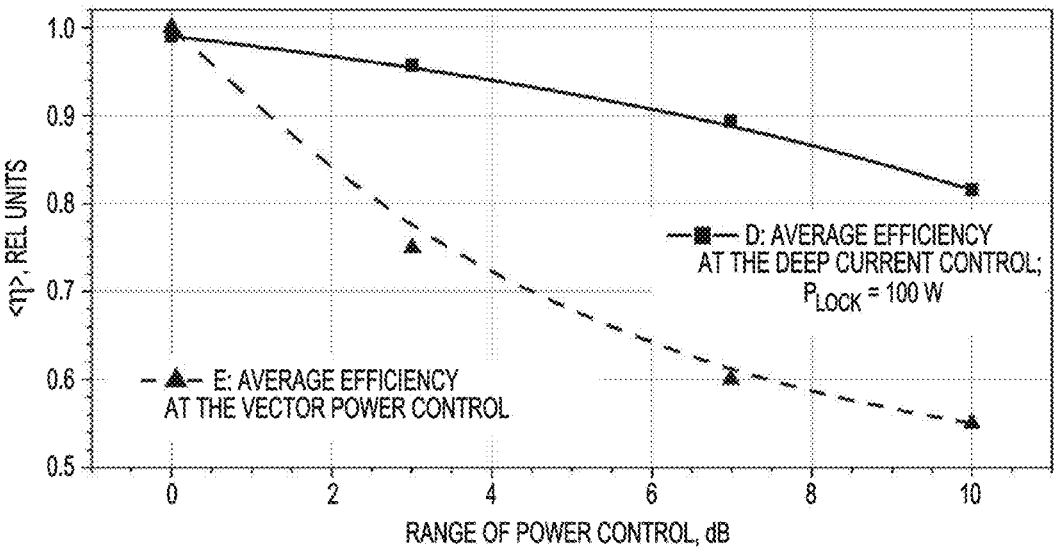
FIG. 3 is a graph showing an example of measured relative averaged magnetron efficiency versus range of power control for various methods of control.

FIG. 3 is a graph showing an example of measured relative averaged magnetron efficiency versus range of power control for various methods of control. In FIG. 3, Trace D shows the average efficiency of the 1.2 kW magnetron driven by the injected resonant signal of −10 dB and measured at the deep magnetron current control, and Trace E shows the average efficiency of 1 kW magnetrons with vector power control [3, 5]. The measurement results as shown in FIG. 3 verified the highest efficiency of the magnetron under such power control in a wide range. The estimated bandwidth of the power control by the current variation presently may be about of 10 kHz with a switching DC HV power supply [2].

Figure 4:
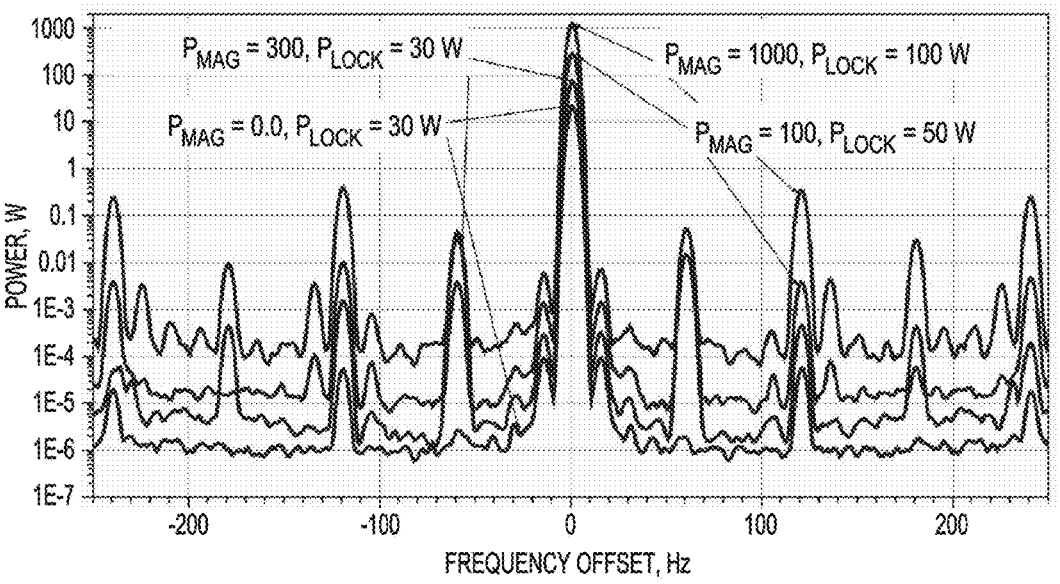
FIG. 4 is a graph showing an example of measured offset of the carrier frequency at various levels of power of the magnetron and the locking signal at the magnetron voltage below and above the threshold of self-excitation.

FIG. 4 is a graph showing an example of measured offset of the carrier frequency at various power levels of the magnetron. Pa., and the locking signal, $P_{Lock}$ at the magnetron voltage below and above the threshold of self-excitation measured in the CW regime. Trace $P_{Mag}$=0.0 W. $P_{Lock}$=30 W shows spectra of the injection-locking signal when the magnetron HV was off. The sidebands seen in all traces are caused by low-frequency modulation of switching power supplies of the TWT amplifier and the magnetron. Spectra of the carrier frequency of the injection-locked CW magnetron fed by voltage below and above the self-excitation threshold at various power levels in the range of 10 dB are precisely-stable and did not demonstrate any broadening or shifts, as shown in FIG. 4 [3]. The presented spectra demonstrate the adequacy of the proposed concept of a transmitter based on a magnetron operating under the self-excitation threshold to requirements for superconducting accelerators. Traces for the magnetron power, $P_{Mag}$=300 W and $P_{Mag}$=100 W were measured below the self-excitation threshold.

Figure 5:
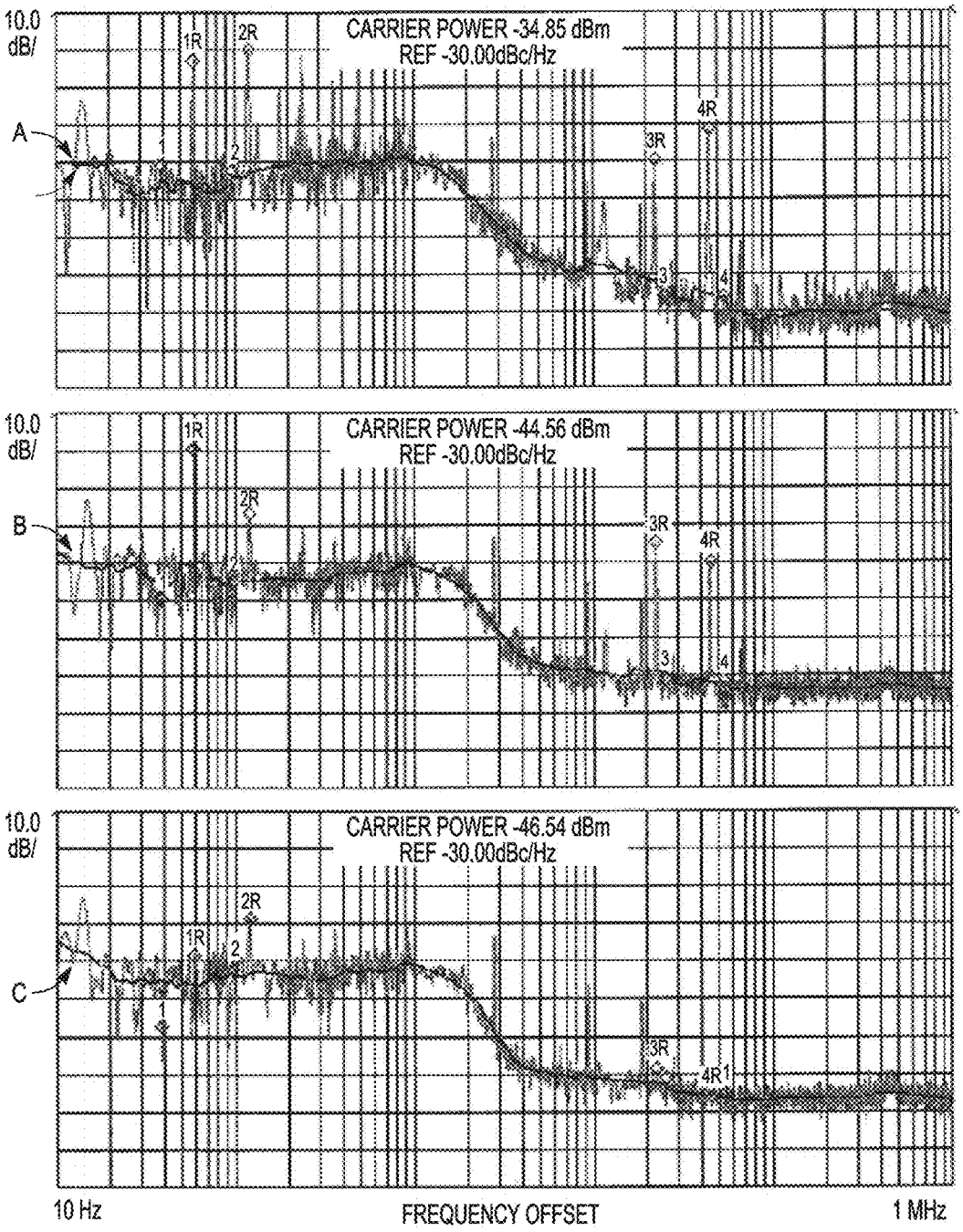
FIG. 5 is a graph showing an example of measured power spectral density of noise of the magnetron operating below and above the threshold of self-excitation.

FIG. 5 is a graph showing an example of measured power spectral density of noise of the frequency-locked magnetron operating above the threshold of self-excitation at output power of 1,000 W (Traces A) and below the threshold of self-excitation at the output power of 100 W (Traces B). Traces C are the spectral power density of the injection-locking signal. Plots A, B, and C include traces showing averaged spectral densities. The measurement results shown in FIG. 5 demonstrate low noise of the magnetron over a wide power range. As shown in FIG. 5, traces C represent spectral power density of the injected resonant signal, where the sidebands are caused by a switching power supply of the TWT amplifier, while Traces A and B also include sidebands caused by switching magnetron HV power supply type SM445G.

Results of measurements performed using the experimental setup illustrated in FIG. 2, such as shown in FIGS. 3-5, verified adequacy of the present magnetron transmitter concept, which uses excitation by the resonant injected signal to operate a magnetron below its voltage of self-excitation to satisfy pulsed power requirements of the SRF cavities. The performed measurements demonstrate capability of CW magnetrons operating at a voltage less than the threshold of self-excitation to be switched on by the resonant wave with an appropriate level, exciting and injection-locking the magnetron. At power of the exciting injection-locking signal of about −10 dB, the magnetron output power may be controlled in this case by the cathode voltage over a range of 5 dB with low noise.

Figure 6:
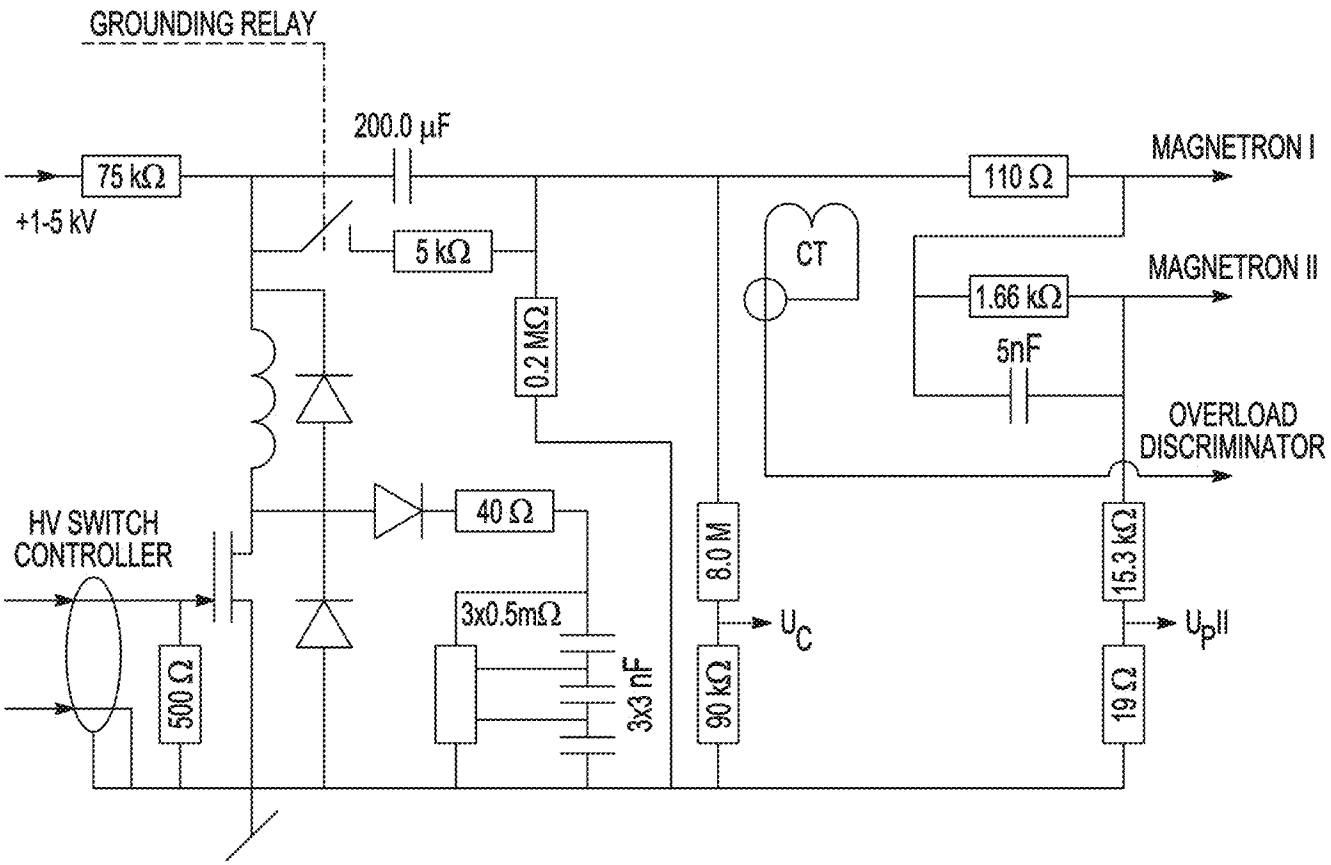
FIG. 6 is a block diagram illustrating an embodiment of a pulsed high voltage (HV) power supply used for studying on-off control of a magnetron operating below the self-excitation threshold and driven by a pulsed resonant injected radio frequency (RF) signal sufficient in power.
Figure 7:
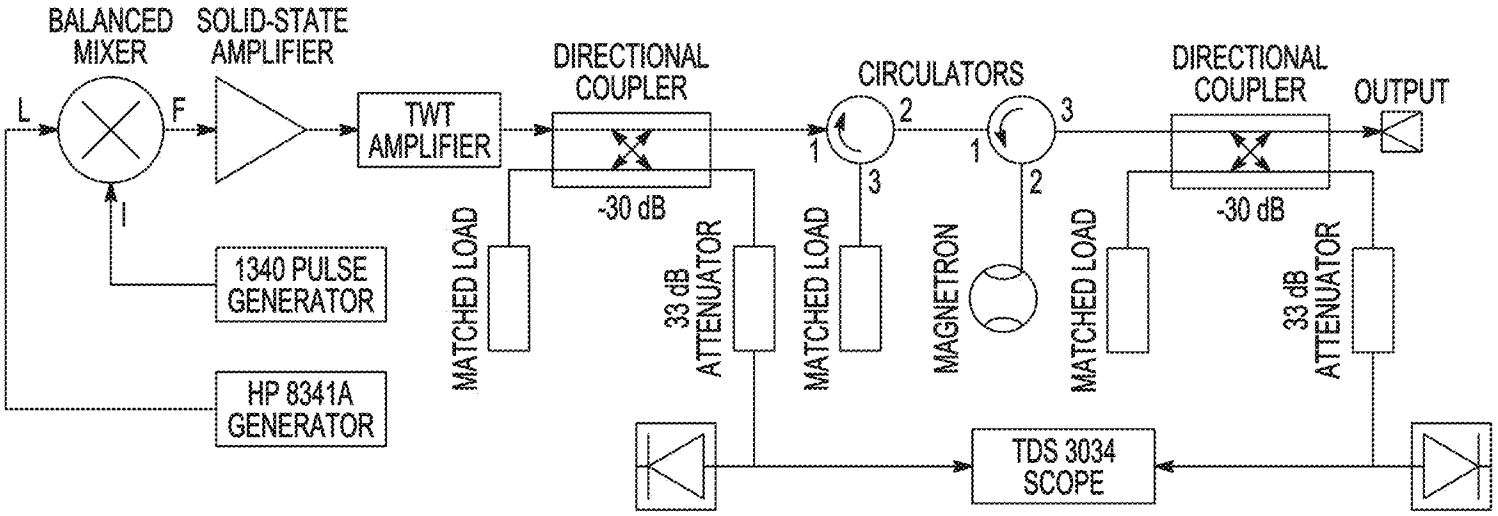
FIG. 7 is a block diagram illustrating an embodiment of an experimental setup for studying the on-off control of the magnetron operating below the self-excitation threshold and driven by a pulsed resonant injected RF signal.

On-off switching control of the magnetron operating below the self-excitation threshold and driven by a pulsed resonant injected signal was studied using a 945 W, 2.45 MHz type 2M219G microwave oven magnetron (e.g., by LG, Seoul, South Korea) and a pulsed HV power supply [1]. The pulse HV power supply provides stabilized voltage in the range of 1-5 kV with negligible low ripple at the pulse duration up to 5 ms. FIG. 6 is a block diagram illustrating an embodiment of a pulsed HV power supply with a Behlke MOSFET IGBT 10 kV/800 A switch. FIG. 7 is a block diagram illustrating an embodiment of an experimental setup for studying the on-off control of the magnetron operating below the self-excitation threshold and driven by a pulsed resonant injected signal. The illustrated experimental setup uses a balanced mixer gated by a pulse generator to shape a train of RF pulses at the resonant frequency. The RF pulses are amplified by solid state and TWT amplifiers to a power level of up to 140 W. The RF pulses drive the magnetron. The injected and the magnetron output RF signals were measured by calibrated RF zero-bias Schottky detectors.

Figure 8:
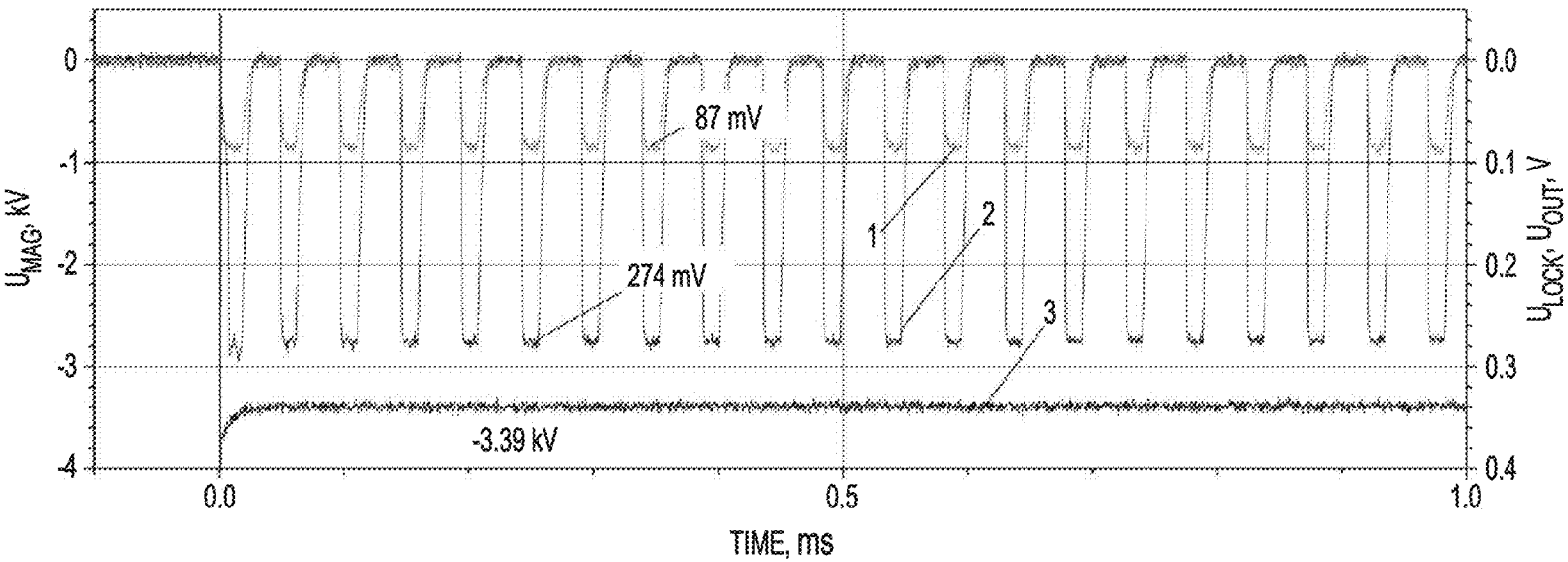
FIG. 8 is a graph showing an example of measured pulsed HV signal powering the magnetron and RF signals measured at the input and output of the magnetron.

FIG. 8 is a graph showing an example of measured pulsed HV signal powering the magnetron and RF signals measured at the input and output of the magnetron. Traces in FIG. 8 show a 20 kHz train of the resonant injected 13 μs signal (Trace 1) and output signal of the magnetron (Trace 2) during the power supply voltage with pulse duration of 5 ms (Trace 3). Measured pulsed powers of the injection-locking signal and the output signal of the magnetron are about 110 W and 770 W, respectively.

Figure 9:
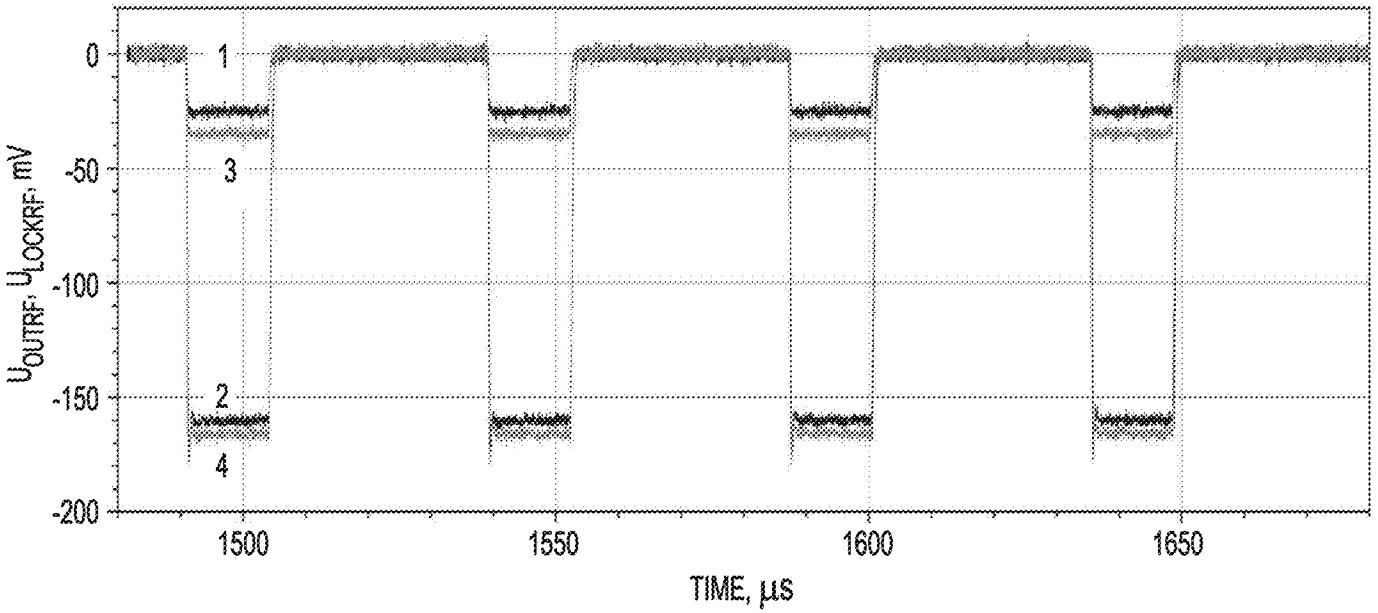
FIG. 9 is a graph showing an example of more detailed shapes of traces of the injection-locking signal and the output signal of the magnetron.

FIG. 9 is a graph showing an example of more detailed shapes of traces of the injection-locking signal and the output RF signal of the magnetron, as measured by the calibrated Schottky detectors with reduced integration time. Traces in FIG. 9 show trains of the injection-locking signals (Trace 1 and 3) and the output signals of the magnetron (Traces 2 and 4) for various powers of the locking signal $P_{Lock}$. Traces 1 and 2 are for the $P_{Lock}$ of about 90 W and 130 W, respectively. Traces 2 and 4 are for powers of the output signal, $P_{Out}$, of about 780 and 830 W, respectively. The measurements demonstrate that the rise and fall times for the magnetron operating below the self-excitation threshold and switched on-off by the injected resonant signal are about of 200 ns.

As it follows from the developed model of the resonant interaction theory [2, 3], the injected resonant signal of about −10 dB improves the phase grouping of the charge in the "spokes" rotating in the magnetron interaction space. This notably increases the RF energy in the magnetron for the entire RF system. Measurements of the output signal of the magnetron using the detector shows that the magnetron switched on-off by the injection-locking signal may provide about 80% of the magnetron nominal power or more. Moreover, the improved phase grouping reduces the electron back-stream overheating the magnetron cathode. This will increase longevity of the magnetron.

APPLICATION EXAMPLES

In various embodiments, if the required pulsed RF power is limited by a few tens of kilowatts, a system for pulsed RF power generation can include an RF pulsed transmitter configured to produce a pulsed RF signal at the magnetron output. The transmitter can include a magnetron, a ferrite circulator or a ferrite circulators system, and a DC power supply. The ferrite circulator (or ferrite circulators system) is used to separate the input pulsed RF signal controlling the internal modulation in the magnetron from the pulsed magnetron output signal due to directivity of these components. The DC power supply can be configured to power the magnetron at a voltage level somewhat below the self-excitation threshold voltage. The input pulsed signal controlling the magnetron can be configured to be sufficient to switch on-off the magnetron (this requires about of 10% of the magnetron nominal power) and to produce the pulsed output RF signal when the tube is powered below the self-excitation threshold voltage.

In various embodiments, a system including the RF pulsed transmitter for powering an accelerating cavity with pulsed RF power of about 100 kW or more can include a low-power magnetron (with power about of 10% of the required output power of the transmitter) with its DC power supply configured to power the low-power tube somewhat below its threshold of self-excitation. The input injected resonant (injection-locking) signal is configured in power (about of 1% of the nominal power of the second, high-power magnetron), to switch on-off the low-power magnetron powered below its self-excitation threshold to produce an injection-locking output pulsed signal with power sufficient to switch on-off the second, high-power magnetron fed by its DC power supply somewhat below the high-power magnetron self-excitation threshold. Inputs-outputs of the low-power and high-power magnetrons can be decoupled by ferrite circulators. The injected resonant signal with power about of 1% of the required output transmitter power controls the precisely-stable stimulated (internal) pulsed modulation of the injection-locked pulsed generation required for high-power pulsed SRF accelerators.

In various embodiments, the circulator or circulator system protects the RF pulsed transmitter from reflected wave. At the beginning of the operation of the system, the SRF cavity is mismatched with the RF pulsed transmitter. This causes a wave with a large magnitude and a large pulsed power to be reflected to the output of the RF pulse transmitter. The circulator or circulator system directs this reflected wave to a matched load to be absorbed by the matched load. Without the circulator or circulator system, such a reflected wave can destroy the magnetron(s). In a system with the low-power and high-power magnetrons, this occurs when there is a discharge in the high-power magnetron. This causes the wave reflected to the low-power magnetron with an amplitude sufficient to cause a discharge in the low-power magnetron. The circulator or circulator system in this case similarly directs this reflected wave to a matched load to be absorbed by the matched load.

Figure 10:
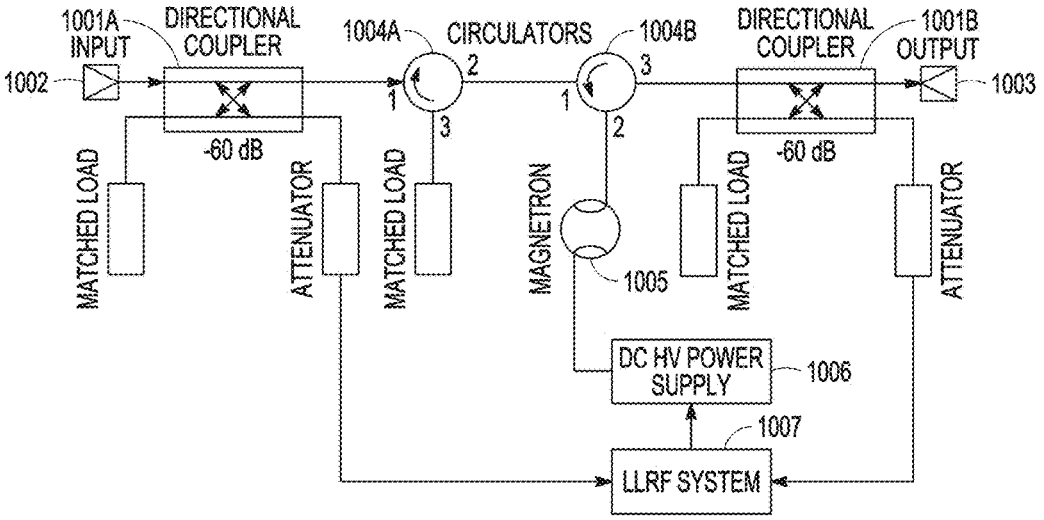
FIG. 10 is a block diagram illustrating an embodiment of a single-stage pulsed magnetron transmitter with internal modulation controlled by an injected pulsed resonant RF signal.

FIG. 10 is a block diagram illustrating an embodiment of a cost-effective single-stage pulsed magnetron transmitter with internal modulation controlled by an injected pulsed resonant RF signal for outputting power up to tens of kilowatts. The transmitter can be implemented using inexpensive components for powering pulsed superconducting accelerators.

The single-stage pulsed magnetron transmitter can include a directional coupler 1001A for measuring a pulsed input RF signal at an input 1002, a directional coupler 1001B for measuring a pulsed output RF signal at an output 1003, circulators 1004A-B (e.g., two T-type ferrite circulators, which alternatively can be replaced by a single 4-port circulator) for decoupling the input and output RF signals, a magnetron 1005, and a DC HV power supply 1006 for feeding the magnetron 1005 below its self-excitation threshold. The input signal controlling internal modulation of the transmitter (the magnetron on-off switching without an HV modulator) is provided by a pulsed RF source with a power of about 10% of the magnetron nominal power. A Low Level RF (LLRF) system 1007 provides for measuring and tuning of the input and output RF signals and control of the DC HV power supply 1006. The illustrated transmitter can provide phase and power control of the RF output signal with rates appropriate for powering an SRF accelerator.

Figure 11:
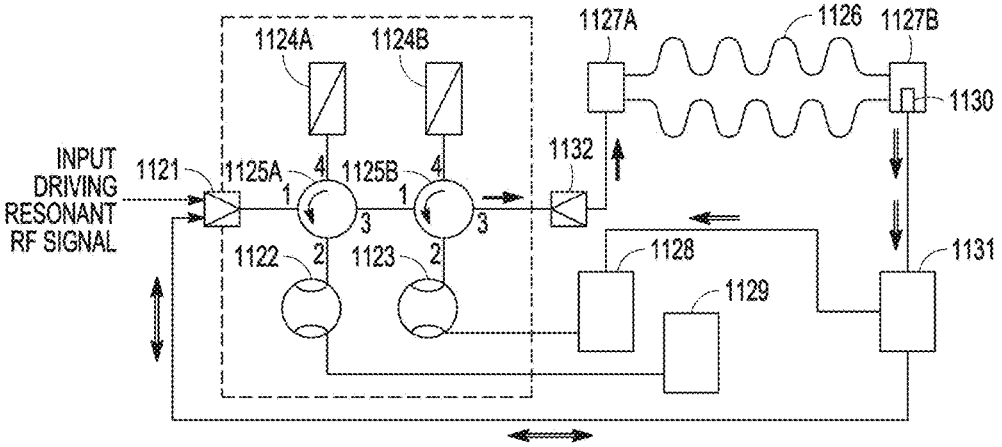
FIG. 11 is a block diagram illustrating an embodiment of a system including a two-stage pulsed magnetron transmitter with internal modulation controlled by an injected pulsed resonant RF signal and a Superconducting RF (SRF) cavity powered by the transmitter.

FIG. 11 is a block diagram illustrating an embodiment of a system including a two-stage pulsed magnetron transmitter with internal modulation controlled by an injected pulsed resonant RF signal and an SRF cavity powered by the transmitter. The transmitter should be cost-effective for output power of hundreds of kilowatts. The illustrated transmitter can be powered by a DC power supply and does not need an HV high-power pulsed modulator, and can provide phase and power control of the RF output signal with rates appropriate for powering an SRF accelerator. In FIG. 11, reference numbers refer to various elements of the system as follows:

- 1121: an input for receiving an injected pulsed resonant RF signal,
- 1122: a low-power magnetron driven by the injected pulsed resonant RF signal and powered below its threshold of self-excitation,
- 1123: a high-power injection-locked magnetron controlled by a cathode voltage.
- 1124A-B: first and second RF matched loads,
- 1125A-B: first and second 4-port circulators.
- 1126: an accelerating cavity (e.g., an SRF accelerating cavity) driven by the high-power magnetron,
- 1127A-B: first and second RF couplers (1127A for powering of the SRF cavity, 1127B for measurements of phase and amplitude of the accelerating field in the SRF cavity),
- 1128: a HV DC power supply for the high-power magnetron,
- 1129: a HV DC power supply for the low-power magnetron.
- 1130: an RF probe (for measuring phase and amplitude of the accelerating field in the SRF cavity),
- 1131: a phase and power controller within an LLRF system.
- 1132: a pulsed RF high-power magnetron output.

The doubled lines with arrows indicate directions of information flow. The heavy lines with arrows indicate directions of RF power flow.

The transmitter as illustrated in FIG. 11 can be a cost-effective high-power, pulsed two-stage [6] RF power source with the internal modulation for pulsed powering of an SRF cavity without using an HV modulator. The RF source can provide phase and power control of the RF output signal with rates appropriate for SRF pulsed accelerators to stabilize the accelerating voltage. The illustrated transmitter is based on an injection-locked two-cascade magnetron system. The control can be realized by comparing the amplitude and phase of the accelerating voltage in the cavity measured by an RF probe with the required parameters. In the illustrated embodiment, the injected pulsed resonant RF signal received by the input 1121 drives the low-power magnetron 1122 via the first 4-port circulator 1125A. The low-power magnetron 1122 operates below its threshold of self-excitation and is switched on-off by the injected pulsed resonant (injection-locking) RF signal. The injection-locked pulsed output RF signal of the low-power magnetron 1122 is then directed via the 4-port circulators 1125A-B to enter the high-power magnetron 1123 operating below its threshold of self-excitation. The output pulsed RF power of the high-power magnetron 1123 drives the SRF cavity 1126 via the first RF coupler 1127A. The output RF signal is controlled in phase in a wide band using the phase and power controller 1131 comparing phase of the injected pulsed resonant RF signal with phase of the signal measured by the RF probe 1130 within a phase feedback loop controlling the LLRF system. The control uses phase modulation of the input injection-locking signal, as demonstrated in reference [3]. The low-power magnetron 1123 provides the required injection-locking pulsed RF signal for the wideband phase control of the high-power magnetron 1123 stably operating with a feeding voltage below the self-excitation threshold and being switched on-off by the low-power magnetron 1122. The power control of the output signal driving the SRF cavity 1126 can be realized by variation of current of the high-power magnetron 1123 controlling the HV DC power supply 1128 via the phase and power controller 1131 and basing on an outcome of measurement of the amplitude of the pulsed RF accelerating field in the accelerating cavity 1126 by the RF probe 1130.

Using two cascaded magnetrons operating below their self-excitation thresholds allows the controlling power of the injected (input) pulsed resonant RF signal to be about 1% of the output RF power.

Some non-limiting examples (Examples 1-20) of the present subject matter are provided as follows:

In Example 1, a system for RF power generation may include an RF pulsed transmitter. The RF pulsed transmitter may be configured to produce a pulsed RF transmitter output signal using a first pulsed magnetron output signal, and may include a transmitter input, a transmitter output, a first magnetron, and a first DC power supply. The transmitter input may receive a pulsed RF transmitter input signal. The transmitter output may transmit the pulsed RF transmitter output signal. The first magnetron has a first self-excitation threshold voltage and may be configured to operate with internal modulation using the pulsed RF transmitter input signal to produce the first pulsed magnetron output signal when being powered at a first voltage level below the first self-excitation threshold voltage. The first DC power supply configured to power the magnetron.

In Example 2, the subject matter of Example 1 may optionally be configured to further include a superconducting RF accelerating cavity coupled to the transmitter output and configured to receive the pulsed RF transmitter output signal and to be powered by the pulsed RF transmitter output signal.

In Example 3, the subject matter of any one or any combination of Examples 1 and 2 may optionally be configured such that the RF pulsed transmitter further include one or more circulators configured to simultaneously direct the pulsed RF transmitter input signal to the first magnetron and the first pulsed magnetron output signal to the transmitter output. The one or more circulators also protect the RF transmitter from a reflected wave.

In Example 4, the subject matter of any one or any combination of Examples 1 to 3 may optionally be configured such that the RF pulsed transmitter further include one or more of a first directional coupler and a second directional coupler. The first directional coupler is coupled between the transmitter input and the first magnetron and configured to allow for measuring the pulsed RF transmitter input signal. The second directional coupler is coupled between the first magnetron and the transmitter output and configured to allow for measuring the pulsed RF transmitter output signal.

In Example 5, the subject matter of Example 4 may optionally be configured such that the RF pulsed transmitter further include a low level RF system configured to measure the pulsed RF transmitter input signal and the pulsed RF transmitter output signal and to control the first DC power supply using an outcome of the measurement.

In Example 6, the subject matter of any one or any combination of Examples 1 and 2 may optionally be configured such that the RF pulsed transmitter further includes a second magnetron and a second DC power supply. The second magnetron has a second self-excitation threshold voltage, is connected in series with the first magnetron (in signals propagation), and is configured to operate with internal modulation using the first pulsed magnetron output signal to produce a second pulsed magnetron output signal when being powered at the second voltage level below the second self-excitation threshold voltage. The second DC power supply is configured to power the magnetron. The RF pulsed transmitter is configured to direct the second pulsed magnetron output signal to the transmitter output to transmit as the pulsed RF transmitter output signal.

In Example 7, the subject matter of Example 6 may optionally be configured such that the RF pulsed transmitter further includes 4-port circulators configured to simultaneously direct the pulsed RF transmitter input signal to the first magnetron, the first pulsed magnetron output signal to the second magnetron, and the second pulsed magnetron output signal to the transmitter output. The 4-port circulators also protect the RF transmitter from a reflected wave.

In Example 8, the subject matter of any one or any combination of Examples 6 and 7 may optionally be configured such that the RF pulsed transmitter further includes a phase and power controller configured to control a power of the pulsed RF transmitter output signal by controlling the second DC power supply.

In Example 9, the subject matter of any one or any combination of Examples 6 to 8 may optionally be configured to further include an SRF accelerating cavity coupled to the transmitter output and configured to receive the pulsed RF transmitter output signal and to be powered by the pulsed RF transmitter output signal, and such that the RF pulsed transmitter further include an RF probe configured to measure a phase and an amplitude of an pulsed RF accelerating field of the SRF accelerating cavity and the phase and power controller is configured to control the phase of the pulsed RF accelerating field based on comparing the measured phase of the pulsed RF accelerating field to a phase of the pulsed RF transmitter input signal and to control the power of the pulsed RF transmitter output signal based on the measured amplitude of the pulsed RF accelerating field.

In Example 10, a method for RF power generation is provided. The method may include receiving a pulsed RF transmitter input signal operating a first magnetron having a first self-excitation threshold voltage, and producing a pulsed RF transmitter output signal using the first pulsed magnetron output signal. Operating the first magnetron may include powering the first magnetron at a first voltage level below the first self-excitation threshold voltage using a first DC power supply and producing a first pulsed magnetron output signal by internal modulation using the pulsed RF transmitter input signal.

In Example 11, the subject matter of Example 10 may optionally further include powering a superconducting RF accelerating cavity using the pulsed RF transmitter output signal.

In Example 12, the subject matter of any one or any combination of Examples 10 and 11 may optionally further include separating the pulsed RF transmitter output signal from the pulsed RF transmitter input signal using one or more circulators.

In Example 13, the subject matter of any one or any combination of Examples 10 to 12 may optionally further include measuring the pulsed RF transmitter input signal and the pulsed RF transmitter output signal and controlling the first DC power supply using an outcome of the measurement.

In Example 14, the subject matter of any one or any combination of Examples 10 and 11 may optionally further include operating a second magnetron having a second self-excitation threshold voltage and transmitting the second pulsed magnetron output signal out as the pulsed RF transmitter output signal. Operating the second magnetron includes powering the second magnetron at a second voltage level below the second self-excitation threshold voltage using a second DC power supply and producing a second pulsed magnetron output signal by internal modulation using the first pulsed magnetron output signal.

In Example 15, the subject matter of Example 14 may optionally further include using circulators to simultaneously directing the pulsed RF transmitter input signal to the first magnetron, the first pulsed magnetron output signal to the second magnetron, and the second pulsed magnetron output signal to an output transmitting the pulsed RF transmitter output signal.

In Example 16, the subject matter of any one or any combination of Examples 14 and 15 may optionally further include powering an SRF accelerating cavity using the pulsed RF transmitter output signal measuring a phase and an amplitude of a pulsed RF accelerating field in the SRF cavity, and controlling the phase and the amplitude of the pulsed RF transmitter output signal by controlling a phase of the pulsed RF transmitter input signal and a voltage of the second DC power supply using an outcome of the measurement.

In Example 17, a system for powering an accelerating cavity may include a magnetron and a cathode voltage supply system. The magnetron may be configured to receive an input injection-locking signal, to produce an injection-locked output signal using the input injection-locking signal when the input injection-locking signal allows the magnetron to operate at a subcritical cathode voltage that is below a critical voltage needed for self-excitation of the magnetron, and to interrupt the injection-locked output signal when the input injection-locking signal is not sufficiently strong to allow the magnetron to operate at the subcritical cathode voltage. The cathode voltage supply system may be coupled to the magnetron and configured to supply the subcritical cathode voltage and to control a power of the injection-locked output signal by controlling the cathode voltage.

In Example 18, the subject matter of Example 17 may optionally be configured such that the cathode voltage supply system is configured to supply the subcritical cathode voltage to allow the magnetron to be turned on and off by controlling the input injection-locking signal.

In Example 19, the subject matter of any one or any combination of Examples 17 and 18 may optionally be configured to further include an additional magnetron connected in series to the magnetron. The additional magnetron is configured to receive the injection-locked output signal and to produce an additional output signal by operating at an additional subcritical cathode voltage that is below a critical voltage needed for self-excitation of the additional magnetron and controls a power of the additional output signal.

In Example 20, the subject matter of Example 19 may optionally be configured such that the additional magnetron is configured to produce the additional output signal being an RF pulsed signal suitable for powering the accelerating cavity being a superconductive RF accelerating cavity.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

REFERENCES

The following references are cited above with reference numbers in brackets and are incorporated by reference herein in their entireties:

[1] G. Kazakevich, "High-Power Magnetron RF Source for Intensity-Frontier Superconducting Linacs", EIC 2014, TUDF1132, http://appora.fnal.gov/pls/eic14/agenda.full, (2014).

[2] G. Kazakevich, R. Johnson, V. Lebedev, V. Yakovlev, V. Pavlov, "Resonant interaction of the electron beam with a synchronous wave in controlled magnetrons for high-current superconducting accelerators", Phys. Rew. Accelerators and Beams 21, 062001 (2018).

[3] G. Kazakevich. V. Lebedev, V. Yakovlev, V. Pavlov, "An efficient magnetron transmitter for superconducting accelerators". Nucl. Instrum. and Methods in Phys. Research. A839, 43-51 (2016).

[4] P. L. Kapitza, HIGH POWER ELECTRONICS. Sov. Phys. Uspekhi. V 5, #5, 777-826, (1963).

[5] B. Chase, R. Pasquinelli, E. Cullerton, P. Varghese, "Precision vector control of a superconducting RF cavity driven by an injection locked magnetron", JINST, 10, P03007, (2015).

[6] G. Kazakevich. R. Johnson. G. Flanagan, F. Marhauser, V. Yakovlev, B. Chase. V. Lebedev, S. Nagaitsev. R. Pasquinelli. N. Solyak, K. Quinn, D. Wolff, V. Pavlov. "High-power magnetron transmitter as an RF source for superconducting linear accelerators", Nucl. Instrum. and Methods in Phys. Research, A 760, 19-27, (2014).

What is claimed is:

1. A system for radio-frequency (RF) power generation, comprising:

an RF pulsed transmitter configured to produce a pulsed RF transmitter output signal using a first pulsed magnetron output signal, the pulsed RF transmitter including:

a transmitter input to receive a pulsed RF transmitter input signal;

a transmitter output to transmit the pulsed RF transmitter output signal;

a first magnetron having a first self-excitation threshold voltage and configured to operate with internal modulation using the pulsed RF transmitter input signal to produce the first pulsed magnetron output signal when being powered at a first voltage level below the first self-excitation threshold voltage; and a first direct-current (DC) power supply configured to power the magnetron.

2. The system of claim 1, further comprising a superconducting RF accelerating cavity coupled to the transmitter output and configured to receive the pulsed RF transmitter output signal and to be powered by the pulsed RF transmitter output signal.

3. The system of claim 1, wherein the RF pulsed transmitter further comprises one or more circulators configured to simultaneously direct the pulsed RF transmitter input signal to the first magnetron and the first pulsed magnetron output signal to the transmitter output and to protect the RF transmitter from a reflected wave.

4. The system of claim 3, wherein the RF pulsed transmitter further comprises one or more of a first directional coupler and a second directional coupler, the first directional coupler coupled between the transmitter input and the first magnetron and configured to allow for measuring the pulsed RF transmitter input signal, the second directional coupler coupled between the first magnetron and the transmitter output and configured to allow for measuring the pulsed RF transmitter output signal.

5. The system of claim 4, wherein the RF pulsed transmitter further comprises a low level RF system configured to measure the pulsed RF transmitter input signal and the pulsed RF transmitter output signal and to control the first DC power supply using an outcome of the measurement.

6. The system of claim 1, wherein the RF pulsed transmitter further comprises:

a second magnetron having a second self-excitation threshold voltage, connected in series with the first magnetron, and configured to operate with internal modulation using the first pulsed magnetron output signal to produce a second pulsed magnetron output signal when being powered at the second voltage level below the second self-excitation threshold voltage; and a second direct-current (DC) power supply configured to power the magnetron, wherein the RF pulsed transmitter is configured to direct the second pulsed magnetron output signal to the transmitter output to transmit as the pulsed RF transmitter output signal.

7. The system of claim 6, wherein the RF pulsed transmitter further comprises 4-port circulators configured to simultaneously direct the pulsed RF transmitter input signal to the first magnetron, the first pulsed magnetron output signal to the second magnetron, and the second pulsed magnetron output signal to the transmitter output and to protect the RF transmitter from a reflected wave.

8. The system of claim 7, wherein the RF pulsed transmitter further comprises a phase and power controller configured to control a power of the pulsed RF transmitter output signal by controlling the second DC power supply.

9. The system of claim 8, further comprising a superconducting RF (SRF) accelerating cavity coupled to the transmitter output and configured to receive the pulsed RF transmitter output signal and to be powered by the pulsed RF transmitter output signal, and wherein the RF pulsed transmitter further comprises an RF probe configured to measure a phase and an amplitude of an pulsed RF accelerating field of the SRF accelerating cavity, and the phase and power controller is configured to control the phase of the pulsed RF accelerating field based on comparing the measured phase of the pulsed RF accelerating field to a phase of the pulsed RF transmitter input signal and to control the power of the pulsed RF transmitter output signal based on the measured amplitude of the pulsed RF accelerating field.

10. A method for radio-frequency (RF) power generation, comprising:

receiving a pulsed RF transmitter input signal;

operating a first magnetron having a first self-excitation threshold voltage, including:

powering the first magnetron at a first voltage level below the first self-excitation threshold voltage using a first direct-current (DC) power supply; and producing a first pulsed magnetron output signal by internal modulation using the pulsed RF transmitter input signal; and producing a pulsed RF transmitter output signal using the first pulsed magnetron output signal.

11. The method of claim 10, further comprising powering a superconducting RF accelerating cavity using the pulsed RF transmitter output signal.

12. The method of claim 10, further comprising separating the pulsed RF transmitter output signal from the pulsed RF transmitter input signal using one or more circulators.

13. The method of claim 12, further comprising:

measuring the pulsed RF transmitter input signal and the pulsed RF transmitter output signal; and controlling the first DC power supply using an outcome of the measurement.

14. The method of claim 10, further comprising:

operating a second magnetron having a second self-excitation threshold voltage, including:

powering the second magnetron at a second voltage level below the second self-excitation threshold voltage using a second DC power supply; and producing a second pulsed magnetron output signal by internal modulation using the first pulsed magnetron output signal; and transmitting the second pulsed magnetron output signal out as the pulsed RF transmitter output signal.

15. The method of claim 14, further comprising using one or more circulators to simultaneously directing the pulsed RF transmitter input signal to the first magnetron, the first pulsed magnetron output signal to the second magnetron, and the second pulsed magnetron output signal to an output transmitting the pulsed RF transmitter output signal.

16. The method of claim 15, further comprising:

powering a superconducting RF (SRF) accelerating cavity using the pulsed RF transmitter output signal;

measuring a phase and an amplitude of a pulsed RF accelerating field in the SRF cavity; and controlling the phase and the amplitude of the pulsed RF transmitter output signal by controlling a phase of the pulsed RF transmitter input signal and a voltage of the second DC power supply using an outcome of the measurement.

17. A system for powering an accelerating cavity, comprising:

a magnetron configured to receive an input injection-locking signal, to produce an injection-locked output signal using the input injection-locking signal when the input injection-locking signal allows the magnetron to operate at a subcritical cathode voltage that is below a critical voltage needed for self-excitation of the magnetron, and to interrupt the injection-locked output signal when the input injection-locking signal is not sufficiently strong to allow the magnetron to operate at the subcritical cathode voltage; and a cathode voltage supply system coupled to the magnetron and configured to supply the subcritical cathode voltage and to control a power of the injection-locked output signal by controlling the cathode voltage.

18. The system of claim 17, wherein the cathode voltage supply system is configured to supply the subcritical cathode voltage to allow the magnetron to be turned on and off by controlling the input injection-locking signal.

19. The system of claim 17, further comprising an additional magnetron connected in series to the magnetron, the additional magnetron configured to receive the injection-locked output signal and to produce an additional output signal by operating at an additional subcritical cathode voltage that is below a critical voltage needed for self-excitation of the additional magnetron and controls a power of the additional output signal.

20. The system of claim 19, wherein the additional magnetron configured to produce the additional output signal being a radio-frequency (RF) pulsed signal suitable for powering the accelerating cavity being a superconductive RF accelerating cavity.

* * * * *